US005864955A

United States Patent [19]

Hirai

[11] Patent Number: 5,864,955

[45] Date of Patent: Feb. 2, 1999

[54] CUTTING TOOL OF A TITANIUM ALLOY COMPLEX

[76] Inventor: Keita Hirai, No. 3-19, 1-chome, Sakae-cho, Kawaguchi-shi, Saitama-ken, Japan

[21] Appl. No.: 838,497

[22] Filed: Apr. 7, 1997

[30] Foreign Application Priority Data

Apr. 8, 1996 [JP] Japan ..... 8-119429

[51] Int. Cl.[6] ..... B26B 9/00

[52] U.S. Cl. ..... 30/350; 76/104.1; 419/6

[58] Field of Search ..... 76/104.1; 30/350, 30/357; 419/6, 7, 9; 428/550

[56] References Cited

U.S. PATENT DOCUMENTS 3,411,208 11/1968 Malm ..... 30/350

4,212,669 7/1980 Veeck et al. ..... 419/6 X

*Primary Examiner*—Douglas D. Watts

*Attorney, Agent, or Firm*—Morrison Law Firm

[57] ABSTRACT

A cutting tool consists of at least one cutting blade. The cutting blade is composed of a blade body, a shank, and a blade edge. The blade body and shank are composed of a titanium alloy having a hardness of less than 20RC. The blade edge is composed of a titanium alloy having a hardness of greater than 35RC. The blade body and blade edge are connected by an intermediate border layer, formed during molding and sintering steps in the production of the cutting blade. The blade body, shank, and blade edge are all formed as a single body. The method for forming the cutting blade comprises the steps of molding different titanium alloy powders at a pressure between 2 and 15 tons/cm$^2$, followed by sintering at 1100° C. to 1300° C.

7 Claims, 1 Drawing Sheet

CUTTING TOOL OF A TITANIUM ALLOY COMPLEX

BACKGROUND OF THE INVENTION

This invention relates to a cutting tool composed of a plurality of titanium alloys. More particularly, this invention relates to a cutting tool made of titanium alloys, in which the chemical composition of the blade base is different from the chemical composition of the blade edge. Also more particularly, this invention relates to a cutting tool intended for domestic use, such as kitchen knives, scissors and the like, which can be manufactured at a low cost.

Regardless of whether intended for professional or for non-professional use, a primary concern for a cutting tool is the sharpness of the cutting blade. Consequently, forged cutting blades of special steels containing, for example, manganese, cobalt, tungsten, molybdenum or the like are preferred for cutting tools. However, cutting tools made of these forged special steels are often expensive, and are therefore unpopular for domestic or nonprofessional use. In addition, cutting tools intended for domestic use tend to rust from lack of care. Therefore, they are often made of stainless steel containing large amounts of nickel and chromium. However, cutting tools made of stainless steel tend to dull more readily.

Recently, titanium alloys are drawing increasing attention for use as a raw material for cutting tools. Titanium does not rust and, because it has a low specific gravity, cutting tools made from titanium are lightweight. Additionally, by employing titanium alloys which include aluminum, vanadium or the like, a substance having very high hardness can be obtained. As a result, the quality of cutting tools made of such a very hard material is excellent. However, such alloys often are expensive, and cutting tools manufactured from such alloys and intended for domestic use have little marketability where the production cost of the raw material is high.

OBJECTS AND SUMMARY OF THE INVENTION

Accordingly, it is an object of the present invention to provide cutting tools, such as kitchen knives, scissors or the like, intended in particular for domestic or nonprofessional use, which are strong, lightweight, and which remain sharp for long periods of time.

It is a further object of the present invention to provide cutting tools, such as kitchen knives, scissors or the like, which are free from rust, endure shock upon dropping, and which can be manufactured at a low cost.

Briefly stated, a cutting tool consists of at least one cutting blade. The cutting blade is composed of a blade body, a shank, and a blade edge. The blade body and shank are composed of a titanium alloy having a hardness of less than 20 Rockwell C ($R_c$). The blade edge is composed of a titanium alloy having a hardness of greater than 35 $R_c$. The blade body and blade edge are connected by an intermediate border layer, formed during molding and sintering steps in the production of the cutting blade. The blade body, shank, and blade edge are all formed as a single body. The method for forming the cutting blade comprises the steps of molding different titanium alloy powders at a pressure between 2 and 15 tons/cm$^2$, followed by sintering at 1100° C. to 1300° C.

According to an embodiment of the present invention, a cutting blade comprises a blade base, a shank, extending from the blade base as a single body, the blade base and the shank being composed of a first sintered titanium alloy having a hardness of less than 20 $R_c$, a blade edge, extending along the blade base, and the blade edge being composed of a second sintered titanium alloy having a hardness of greater than 35 $R_c$.

According to another embodiment of the present invention, a method for producing a cutting blade comprises the steps of filling a mold with a first titanium alloy powder and a second titanium alloy powder, the first sintered titanium alloy powder effective for forming an alloy having a hardness of less than 20 $R_c$, the second sintered titanium alloy effective for forming an alloy having a hardness of greater than 35 $R_c$, the mold forming a blade base and a shank, the blade base and the shank being made of the first titanium alloy powder, the mold forming a blade edge, the blade edge being made of the second titanium alloy powder, molding the first and second titanium alloy powders under a pressure of about 2 to 15 tons/cm$^2$, and sintering at a temperature of about 1100 ° C. to 1300 ° C., whereby an intermediate border layer is formed between the blade base and the blade edge through inter-particle cohesion of the first and the second titanium alloy powders.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENTS

Embodiment 1

Figure 1:
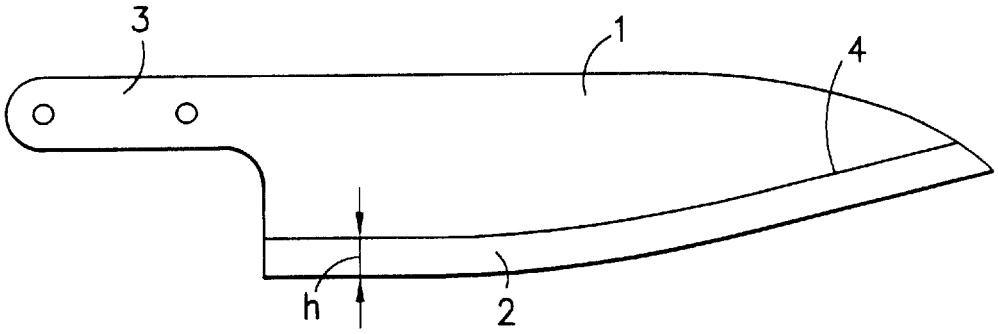
FIG. 1 represents a side view of an embodiment of the present invention.

Referring to FIG. 1, which represent a kitchen knife blade according to the present invention, a shank 3 and a blade edge 2 extend from a blade base 1 in a single body construction. An intermediate layer 4 is present between blade base 1 and blade edge 2.

Blade base 1 is made of a sintered titanium alloy powder having a chemical composition of 95 –99% pure titanium, and has a hardness of less than 20 $R_c$. Blade edge 2 is made of a different sintered titanium alloy powder having a chemical composition of 72% titanium, 15% vanadium, 3% aluminum, 5% chromium, and 5% tin, and has a hardness of over 35 $R_c$. The blade edge portion should have a hardness greater than 35 $R_c$, because a hardness less than 35 $R_c$ will provide insufficient sharpness to the cutting blade.

For a cutting tool of the present invention, height h is very small, compared to the height of blade base 1. When an external force acts on blade edge 2, blade base 1 acts as a buffer body for blade edge 2. However, when hardness of blade base 1 is over 20 $R_c$, the buffer body action of blade base 1 for blade edge 2 is insufficient, so that damage or destruction of blade edge 2 may eventually occur. In addition, because the cost of the titanium alloy of blade edge 2 is higher than the cost of the titanium alloy of blade base 1, the manufacturing cost is minimized where h is much less than the height of blade base 1. Accordingly, a cutting tool according to the present invention can be produced at a cost of at least several ten percent lower than a conventional cutting tool of the same level of quality which is composed entirely of a single titanium alloy.

In the present invention relatively hard (greater than 35 $R_c$) blade edge 2 is connected tightly to comparatively soft (less than 20 $R_c$) blade base 1 through the medium of intermediate sintered border layer 4. Therefore, blade base 1, which closely supports blade edge 2, provides flexibility to blade edge 2 and protects blade edge 2 against external forces. As a result, physical impacts, such as those caused by dropping the cutting tool on a floor or other hard surface, produce less damage to the cutting tool.

A cutting tool of the present invention, such as a kitchen knife as shown in FIG. 1, is produced by molding under a pressure of about 2 to 15 tons/cm$^2$, followed by sintering at about 1100 ° C. to 1300 ° C. The foregoing molding process includes charging two kinds of alloy powders at portions of the mold which are to correspond to blade base 1 and blade edge 2. No barrier wall is present between the charged alloy powders. A mold for this molding process has an inner space, for filling powders, having a shape of a cutting blade as desired. Compressing and sintering operations within the mold complete the charging operation of the alloy powders. Intermediate border layer 4, which is produced by inter-particle cohesion of the charged alloy powders, is formed in the course of the molding and sintering operations.

Embodiment 2

This embodiment is similar to Embodiment 1, except that the titanium alloy powder for blade edge 2 comprises 90% titanium, 6% aluminum, and 4% vanadium. Blade edge 2 made of this titanium alloy has a hardness of 40 to 45 $R_c$.

Embodiment 3

This embodiment relates to common scissors having a pair of blades. 5 Each one of the pair of blades is composed of blade base 1, blade edge 2, shank 3, and intermediate border layer 4, in the same way as in Embodiment 1. The pair of blades are pivoted slidably to each other at about the middle of blade base 1 and shank 3, to shear objects placed between blade edges 2. Each one of blade base 1, shank 3, and blade edge 2, has the same chemical composition as noted in Embodiment 1. Respective blades are made in the same way as noted in Embodiment 1.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A cutting blade comprising:

a blade base;

a shank, extending from said blade base as a single body;

said blade base being composed of a first sintered titanium alloy having a hardness of less than 20 $R_c$;

a blade edge, extending along said blade base; and said blade edge being composed of a second sintered titanium alloy having a hardness of greater than 35 $R_c$;

wherein:

said blade base and said shank include between about 95% and 99% titanium; and said blade edge includes about 72% titanium, about 15% vanadium, about 3% aluminum, about 5% chromium, and about 5% tin.

2. A cutting blade, comprising:

a blade base;

said blade base being composed of a first sintered titanium alloy having a hardness of less than 20 $R_c$;

a blade edge, extending along said blade base; and said blade edge being composed of a second sintered titanium alloy having a hardness of greater than 35 $R_c$;

wherein said blade edge includes about 90% titanium, about 6% aluminum, and about 4% vanadium.

3. A method for producing a cutting blade, comprising the steps of:

filling a mold with a first titanium alloy powder and a second titanium alloy powder;

said first titanium alloy powder effective for forming an alloy having a hardness of less than 20 $R_c$;

said second titanium alloy powder effective for forming an alloy having a hardness of greater than 35 $R_c$;

said mold forming a blade base being made of said first titanium alloy powder;

said mold forming a blade edge, said blade edge being made of said second titanium alloy powder;

molding said first and second titanium alloy powders under a pressure of about 2 to 15 tons/cm$^2$; and sintering at a temperature of about 1100° C. to 1300° C., whereby an intermediate border layer is formed between said blade base and said blade edge through inter-particle cohesion of said first and said second titanium alloy powders.

4. A method for producing a cutting blade according to claim 3, wherein:

said mold forms a shank, said shank being made of said first titanium alloy powder; and said shank is formed continuously with said blade base.

5. A method for producing a cutting blade according to claim 3, wherein said first titanium alloy powder comprises about 95 to 99% titanium.

6. A method for producing a cutting blade according to claim 3, wherein said second titanium alloy powder comprises about 72% titanium, about 15% vanadium, about 3% aluminum, about 5% chromium, and about 5% tin.

7. A method for producing a cutting blade according to claim 3, wherein said second titanium alloy powder comprises about 90% titanium, about 6% aluminum, and about 4% vanadium.

* * * * *